United States Patent [19]

Kotlarek et al.

[11] Patent Number: 4,867,657

[45] Date of Patent: Sep. 19, 1989

[54] SCROLL COMPRESSOR WITH AXIALLY BALANCED SHAFT

[75] Inventors: Peter A. Kotlarek; Delmar R. Riffe, both of La Crosse, Wis.

[73] Assignee: American Standard Inc., New York, N.Y.

[21] Appl. No.: 212,766

[22] Filed: Jun. 29, 1988

[51] Int. Cl.[4] ..... F04C 18/02

[52] U.S. Cl. ..... 418/55; 418/188; 417/365

[58] Field of Search ..... 418/55 D, 57, 183, 188; 417/365

[56] References Cited

U.S. PATENT DOCUMENTS

| | | | |
|---|---|---|---|
| 3,884,599 | 5/1975 | Young et al. | 418/188 X |
| 3,994,633 | 11/1976 | Shaffer | 418/5 |
| 4,365,941 | 12/1982 | Tojo et al. | 418/55 D X |
| 4,457,675 | 7/1984 | Inagaki et al. | 418/55 D X |
| 4,552,518 | 11/1985 | Utter | 418/188 X |
| 4,645,437 | 2/1987 | Sakashita et al. | 418/55 D |
| 4,795,322 | 1/1989 | Etemad et al. | 418/55 D |

*Primary Examiner*—Carlton R. Croyle
*Assistant Examiner*—Leonard P. Walnoha
*Attorney, Agent, or Firm*—William J. Beres; David L. Polsley; Robert J. Harter

[57] ABSTRACT

In a compressor of the hermetic, scroll-type, a motor engaging drive shaft having a net axial thrust load determined by the pressure of compressed fluid acting upon the opposing ends of the shaft. In the preferred embodiment, the shaft includes a first end in the discharge pressure portion providing a first plan view area and a second end in the suction pressure portion having a circular, eccentrically disposed cavity with a second plan view area. The shaft has an axial bore for communicating refrigerant at discharge pressure through the shaft between the respective ends such that refrigerant at discharge pressure acts in opposite directions upon both of the respective plan view areas to balance the net thrust load of the shaft.

11 Claims, 1 Drawing Sheet

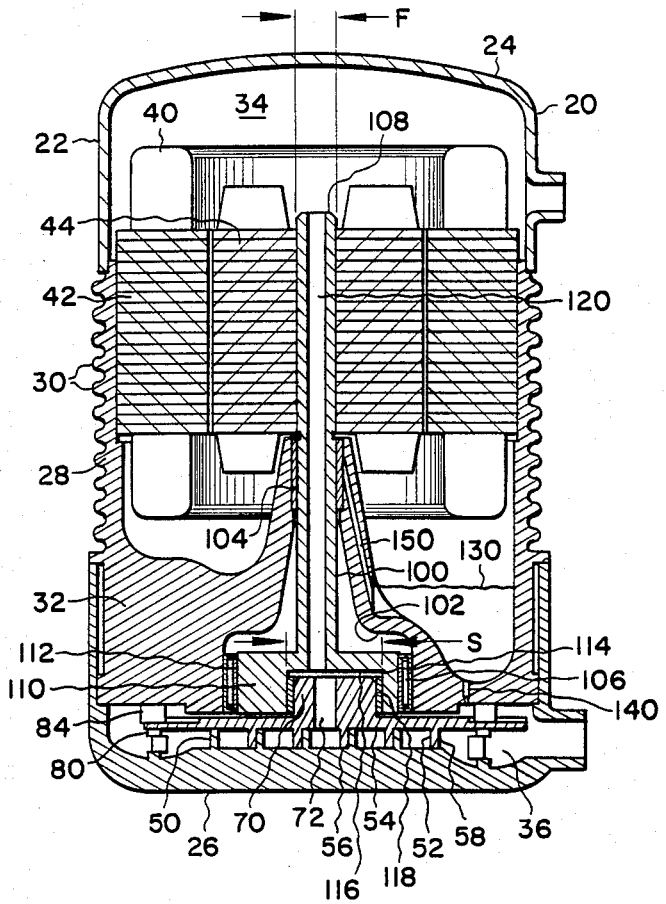
FIG. 1
FIG. 2
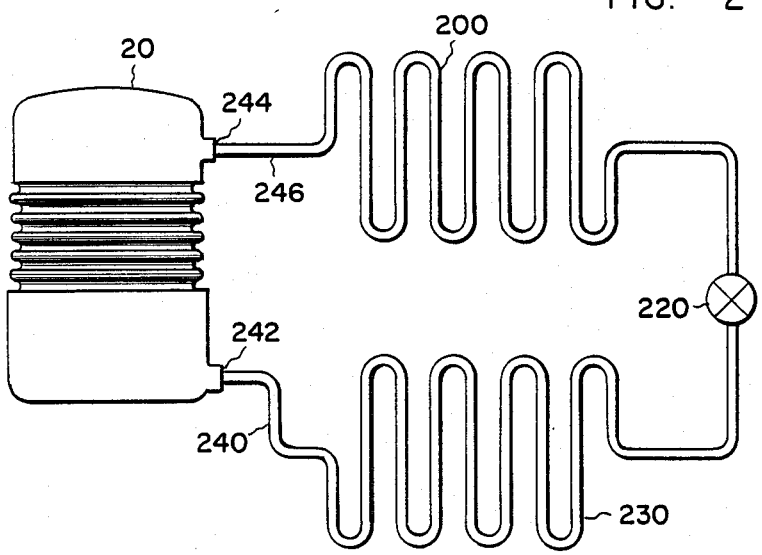

SCROLL COMPRESSOR WITH AXIALLY BALANCED SHAFT

TECHNICAL FIELD

This invention generally pertains to the drive shaft of a compressor and specifically to scroll compressors having drive shafts subject to axial thrust loading.

BACKGROUND OF THE INVENTION

Typically, scroll-type apparatus, whether used for compression or expansion of fluid, include a drive shaft for operating at least one of the scroll elements in non-rotating orbiting engagement with the other scroll element. When the scroll-type apparatus is used for compression, the fluid under compression tends to separate the end plates supporting the scroll elements. This separation is typically counteracted by the provision of one or more thrust bearings acting on the orbiting scroll element. However, in some hermetic scroll compressors, particularly those having the motor disposed in the discharge pressure portion of the hermetic shell, there is a net axial thrust load on the drive shaft extending between the motor and the orbiting scroll element. This arises because the drive shaft typically has one end disposed in the discharge pressure portion with a plan view of the end subject to discharge pressure and a second end disposed in the suction pressure portion with a plan view subject to suction pressure. Since the suction pressure is lower than the discharge pressure, the shaft is under a net thrust load tending toward the suction pressure portion of the hermetic shell.

Typically, the drive shaft is fitted with a thrust bearing to prevent the shaft from moving in an axial direction. This is undesirable in that energy is dissipated in the thrust bearing which would otherwise be used in operating the orbiting scroll element. This reduces the efficiency of the compressor and requires a larger motor than otherwise would be required if the thrust load were not present. Furthermore, the thrust bearing is often relatively more expensive and subject to higher wear, reducing the service life of the compressor and increasing maintenance requirements.

Therefore it is an object of the present invention to increase the efficiency of a compressor apparatus by eliminating the requirement for a thrust bearing on the drive shaft.

It is a still further object of the invention to decrease the cost of operation and manufacture of such a compressor assembly.

It is yet a still further object of the present invention to accomplish the foregoing objects while increasing the operating life and reducing the maintenance requirements of such a compressor apparatus.

These and other objects of the invention will be apparent from the attached drawings and the description of the preferred embodiment that follows hereinbelow.

SUMMARY OF THE INVENTION

The subject invention is a drive shaft for a compressor apparatus, preferably of the scroll-type. The subject invention comprises a drive shaft having an end with a plan view disposed in a discharge pressure portion of a hermetic shell and a second end disposed in the suction pressure portion of a hermetic shell. The second end includes a cavity defined by a circular side wall and a recessed surface. The cavity cooperates with the drive stub of an orbiting scroll element to define a closed chamber containing compressed fluid at discharge pressure. The plan view of the recessed surface in the chamber and the plan view of the shaft end in the discharge pressure portion are porportioned in size to provide a net axial thrust on the drive shaft as desired. Thus, the net axial thrust upon the drive shaft may be selected by preparing a drive shaft having the desired plan views area exposed to discharge pressure, permitting the use of bearings having radial load bearing capability only and eliminating the requirement for a thrust bearing for the drive shaft.

BRIEF DESCRIPTION OF THE DRAWING

FIG. 1 shows a hermetic compressor including a drive shaft embodying the subject invention.

FIG. 2 shows a schematic representation of a refrigeration system including a hermetic compressor embodying the subject invention.

DESCRIPTION OF THE PREFERRED EMBODIMENT

A compressor system generally denoted by reference numeral 20 is shown in FIG. 1. Compressor system 20 is a rotary compressor, housed in a hermetic shell 22. Preferably, the hermetic shell is generally cylindrical, comprised of an upper portion 24, a lower portion 26 and a central portion 28. The central portion 28 includes a peripheral heat exchange portion composed of a plurality of parallel, spaced annular ribs 30 for providing heat exhange from the interior or the hermetic shell 22 to the exterior environment. The central portion 28 of the hermetic shell 22 also includes a frame portion 32 for separating the hermetic shell 22 into a discharge pressure portion 34 and a suction pressure portion 36.

The central portion 28 would preferably be secured by welding to the upper portion 24 and the lower portion 26, at their respective peripheral edges, so that the shell 22 is suitably divided into the discharge and suction pressure portions.

A motor 40 is disposed in the discharge pressure portion 34 of the hermetic shell 22. The motor 40 is preferably an electric motor having a fixed stator 42 and a rotatable rotor 44 separated by an annular space. The motor is not described in detail, as it is believed that the art of the electric motor is generally well understood. However, the motor 40 would generally preferably be an electric motor operating on single or threephase alternating current. It would also be possible to operate the compressor assembly 20 as a variable speed device by including a suitable electric motor 40 or a suitable controller (not shown) for varying the speed of the motor 40.

The compressor assembly 20 in the preferred embodiment is preferably a scroll-type compressor of the type having one fixed scroll wrap 50 and one relative orbiting scroll wrap 52. The fixed scroll wrap 50 is affixed to or formed as part of the lower hermetic shell portion 26 such that a portion of the lower hermetic shell portion 26 comprises a substantially planar surface acting as an end plate for sealing orbital engagement with the orbiting scroll wrap 52. The orbiting scroll wrap 52 is secured to or formed as part of an orbiting end plate 54.

The fixed scroll wrap 50 and the orbiting scroll wrap 52 are involute in form, each having a tip 56 for sealingly engaging the opposing end plate and flank surfaces 58 for sealing line contact engagement with the flank surface 58 of the adjacent scroll wrap.

The orbiting scroll end plate 54 also includes a circular drive stub 70 disposed opposite from the orbiting scroll wrap 52. Drive stub 70 is preferably cast as an integral part of the end plate 54, and located approximately in the center of the end plate 54. A discharge port aperture 72 is defined through the end plate 54 and the drive stub 70 by a bore adjacent the inner radial end of the orbiting scroll wrap 52. This discharge port aperture 72 permits fluid communicating from the scroll wraps 50 and 52 when fluid is compressed therein.

The compressor assembly 20 further includes an Oldham coupling 80 or similar anti-rotation device for preventing rotation of the orbiting end plate 54 while permitting the end plate 54 to move orbitally about an axis. Such anti-rotation devices as the Oldham coupling 80 are believed to be generally well understood in the art and are not disclosed herein, as a detailed understanding of such devices is not believed necessary to the comprehension of the subject invention.

A thrust bearing 84 is disposed between the central frame portion 32 and the orbiting scroll end plate 54 to ensure appropriate axial engagement of the respective scroll tips 56 with the opposing end plates. It is equally possible to ensure engagement of the scroll tips 56 by applying fluid at discharge pressure or a pressure intermediate the discharge and suction pressure to a selected portion of the orbiting scroll end plate. Both the thrust bearing 84 and the use of fluid pressure for this purpose is well known to those skilled in the art and is not discussed herein for that reason. See, e.g. U.S. Pat. No 4,715,733.

A drive shaft 100 is disposed within the hermetic shell 22. The drive shaft 100 extends through a frame aperture 102 in the central frame portion 32. This frame aperture 102 is substantially centrally located so that the drive shaft 100 communicates from the discharge pressure portion 34 to the suction pressure portion 36. The frame aperture 102 also includes an upper radial bearing 104 and a lower radial bearing 106 disposed between the drive shaft 100 and the frame aperture 102 for permitting rotational motion of the drive shaft 100.

Bearing 104 may be a sleeve bearing formed, for example, of sintered bronze, or may be a roller bearing (as shown for bearing 106) or a ball bearing. In any case, bearing 104 should substantially seal between the drive shaft 100 and the frame aperture 102 to prevent leakage of fluid from the discharge pressure portion 34 to the suction pressure portion 36. A separate sealing element (not shown) could also be employed to accomplish this. It should be noted that a minimal amount of fluid leakage may be desirable in some cases to assist with the flow of oil through bearings 104 and 106.

The drive shaft 100 includes a first end 108 disposed in the discharge pressure portion 34 and a second end comprising a crank portion 110 disposed in the suction pressure portion 36. The crank portion 100 has a circular exterior 112 for rotational engagement with the lower radial bearing 106 and a relatively eccentric, circular interior side wall 114 about a recessed planar surface 116 which defines a crank cavity for engagement with the drive stub 70. Preferably, a bearing 118 is disposed between the circular side wall 114 and the drive stub 70 for permitting the transfer of rotational motion from the drive shaft 100 to the drive stub 70. The bearing 118 provides a sealing engagement to define a closed chamber between the drive stub 70, the recessed planar surface 116 and the circular side wall 114.

A discharge gallery 120 extends axially through the drive shaft 100, providing flow communication between the chamber defined in the crank portion 110 of the drive shaft 100 and the discharge pressure portion 34. In its simplest form, the discharge gallery 120 is simply an axial bore connecting between the planar recess 116 and the opposite end of the drive shaft 100.

The central frame portion 32 preferably includes a depression for containing a reservoir of lubricant 130. Preferably, this lubricant is an oil of a type commonly used in refrigeration systems. A lubricant metering aperture 140 is provided in the lower most portion of the lubricant reservoir 130. This lubricant metering aperture 140 is a relatively small bore sized to provide a suitable, continuous flow of lubricant from the lubricant reservoir 130 to the suction pressure portion 36 of the hermetic shell 22.

A bore defining a lubricant passage 150 from the lubricant reservoir 130 to the upper radial bearing 104 is also defined in the central frame portion 32.

For operation of the compressor assembly 20, the motor 40 is actuated, so that rotor 44 rotates. The rotor 44 is drivingly connected to the drive shaft 100 to transmit this rotation by such means as a relative press fit or a drive key and corresponding keyways (not shown). Drive shaft 100 rotates in the frame aperture 102 on bearings 104 and 106, while imparting rotation to the drive stub 70 through the bearing 118 in the crank cavity defined by side wall 114. The orbiting scroll end plate 54 attached to the drive stub 70 is constrained by the Oldham coupling 80 to an orbital motion relative to the fixed scroll wrap 50, causing the formation of a plurality of chambers between the flanks 58 of the relative scroll wraps. The volume of the chambers thus formed diminishes toward the radial interior end of the wraps 50 and 52 such that fluid is drawn into chambers forming at the radial interior ends of the wraps 50 and 52, compressed as the chambers orbit toward the radially interior ends of the wraps 50 and 52, and discharged through the discharge port aperture 72.

The discharge fluid enters the closed chamber defined by the drive stub 70, the recessed planar surface 116 and the circular side wall 114. From this chamber, the fluid is communicated to the discharge pressure portion 34 through the discharge gallery 120 in the drive shaft 100.

In operation, as the refrigerant or fluid is compressed as mentioned hereinabove, the discharge pressure fluid forces a small flow of lubricant through the lubricant metering aperture 140 and the lubricant passage 150. The lubricant entering the suction pressure portion 36 lubricates the Oldham coupling mechanism, any thrust bearings applied to the orbiting scroll end plate 54 and to the tip 56 and flank 58 surfaces of the respective scroll wraps. Lubricant forced through the lubricant passage 150 lubricates the upper radial bearing 104 and flows from the bearing 104 to the lower radial bearing 106 and thence into the suction pressure portion 36. The lubricating oil is then entrained by the refrigerant or fluid being compressed and is forced through the discharge port aperture 72 and the discharge gallery 120 into the discharge pressure portion 34 wherein it disentrains from the compressed fluid or refrigerant, as the case may be and flows downwardly through the annular space between the stator 42 and rotor 44 into the lubricant reservoir 130, or between 42 and 28 through alternate passages (not shown).

Upon examination of FIG. 1 and the foregoing description, it will be apparent that only the plan view areas bounded by diameters S and F produce axial thrust upon the drive shaft 100, since all pressure forces acting in any direction normal to the axis of the drive shaft 100 is cancelled by an opposite opposing force. The plan view area is that area viewed in parallel with the axis of the drive shaft 100. Therefore, it can be seen that the net thrust load on the drive shaft 100 is determined by the discharge pressure acting on the planar recess 116 and the end of the drive shaft 100 disposed in the discharge pressure portion 34. The crank portion 110 is subject to the pressure of fluid at suction pressure on all sides except in the planar recess 116, and therefore exerts no substantial net thrust load on the drive shaft 100. Therefore, the net axial thrust load is determined by the plan view area determined by a diameter F of the drive shaft 100 as opposed to the plan view area determined by a diameter S of the planar recess 116. For example, the value of S and F can be made equal to provide a pressure balance of zero net axial thrust on the drive shaft 100, or the value of the diameter S can be made larger than the value of the diameter F such that the drive shaft 100 acts to support the weight of the rotor 44 to which it is attached.

Preferably, the compressor assembly 20 would be utilized in an air conditioning or refrigeration system having a condenser 200 for condensing refrigerant to a liquid form, an expansion valve 220 for receiving the liquid refrigerant from the condenser 200 and expanding the refrigerant, an evaporator 230 for receiving expanded refrigerant from the expansion valve 220 and evaporating the refrigerant, a suction line 240 for transferring the evaporated refrigerant to a suction port 242 in the lower portion 26 of the hermetic shell 22 such that the refrigerant is received in the suction pressure portion 36. The refrigerant is then compressed as described above and discharged from the compressor assembly 20 through a discharge port 244 and thence through a discharge line 246 to the condenser 200. A schematic representation of such an air conditioning system is shown in FIG. 2.

In such an air conditioning system, the compressor assembly 20 might be, for example, in the 5 ton to 15 ton capacity range. The refrigerant pressure experienced at the suction port 242 would typically be in the range of 0 to 100 pounds/square inch, while the refrigerant discharge pressure provided by the compressor assembly 20 at the discharge port 244 would typically be in the range of 200 to 400 pounds/square inch. The combined weight of the rotor 44 and the drive shaft 100 would typically be within the range of 5 to 35 pounds. The diameter 5 then, for example, might be 125% of the diameter F such that the net axial thrust load of the drive shaft 100 would support the rotor 44 and the drive shaft 100 during normal operation of the compressor assembly 20, thus eliminating the need for a thrust bearing to support the drive shaft 100. The weight of the rotor 44 and the drive shaft 100 is transferred to the orbiting scroll end plate 54 through the discharge pressure gas in the chamber. This provides the additional benefit of increasing the axial compliance, and thus the efficiency, of the scrolls 50 and 52.

It will be apparent to those skilled in the art that such a refrigeration system could include multiple compressor assemblies 20, or multiple other components as well as additional refinements such as hot gas defrost, all as is known to those skilled in the art.

The compressor assembly 20 having the axially pressure balanced drive shaft 100 provides a simplified and less expensive compressor construction, having lower maintenance requirements and lower power requirements, eliminating the requirement of an inefficient and power reducing thrust bearing. It will also be apparent that the axially pressure balanced drive shaft 100 permits substantial latitude in the compressor design, in that the drive shaft 100 load may be varied by the appropriate selection of diameters S and F to obtain the desired opposing plan view areas.

Modifications to the preferred embodiment of the subject invention will be apparent to those skilled in the art within the scope of the claims that follow hereinbelow.

What is claimed is:

1. A fluid compressor comprised of:

a hermetic shell including a frame dividing said hermetic shell into a suction pressure portion and a discharge pressure portion, said frame further including a general central bore:

a first scroll member rotatably disposed in the suction pressure portion of said hermetic shell, said first scroll member having an end plate with a first upstanding involute portion and a drive stub, said drive stub further having a bore defining a discharge aperture;

a second upstanding scroll involute in the suction pressure portion of said hermetic shell, said second scroll involute in interleaving engagement with said first scroll involute;

a motor disposed in the discharge pressure portion of said hermetic shell;

an axially pressure balanced drive shaft rotatably disposed in said hermetic shell in driving connection with said motor, said drive shaft having an axial bore for communicating refrigerant from said interfitting scroll involutes to said discharge pressure portion, said drive shaft further having a first end in the central bore of said frame, said first end substantially sealing said central boreand having an exterior diameter F, and a second end defining a circular cavity eccentric to said axial bore having a cavity diameter S for rotationally accepting said drive stub, said second end disposed in the suction pressure portion of said hermetic shell for biasingly engaging said drive stub of said first scroll member;

means for bearing rotational motion between the second section of said drive shaft and the drive stub whereby said drive stub and said drive shaft cooperate to form a chamber, said bearing means further providing a seal between the enclosed chamber defined by the drive stub and the drive shaft and the suction pressure portion wherein the drive shaft is axially pressure balanced by fluid at discharge pressure acting on an area bounded by the cavity diameter S and the fluid at discharge pressure acting on an area bounded by the exterior diameter F.

2. The fluid compressor as set forth in claim 1 wherein the frame is further operative to support the motor within said hermetic shell.

3. The fluid compressor as set forth in claim 2 wherein the frame further includes a lubricant reservoir.

4. The fluid compressor as set forth in claim 3 wherein the frame further includes a lubricant metering aperture for metering flow communication of a lubricant from said lubricant reservoir to said suction pressure portion wherein said lubricant is entrained with the field.

5. The fluid compressor as set forth in claim 4 wherein said motor includes a stator and a rotor defining an annular space in which the lubricant is disentrained from said fluid and through which the disentrained lubricant flows to said reservoir.

6. The fluid compressor as set forth in claim 3 wherein the frame further includes means for bearing rotational motion of said drive shaft.

7. The fluid compressor as set forth in claim 6 wherein said bearing means further comprises a seal between said discharge pressure portion and said suction pressure portion.

8. The fluid compressor as set forth in claim 7 wherein the frame further includes a lubricant passage from said lubricant reservoir to said bearing.

9. The fluid compressor as set forth in claim 1 wherein the diameter S is relatively larger than the diameter F for supporting the weight of the drive shaft and a portion of the weight of the motor.

10. A refrigeration system for circulating refrigerant in closed loop connection comprised of:

a condenser for condensing refrigerant to liquid form;

an expansion valve for receiving liquid refrigerant from said condenser and expanding the refrigerant;

an evaporator for receiving expanded refrigerant from said expansion valve and evaporating the refrigerant; and a compressor for receiving evaporated refrigerant from said evaporator and compressing the refrigerant, said compressor comprised of;

a hermetic shell including a frame dividing said hermetic shell into a suction pressure portion and a discharge pressure portion, said frame further including a generally central bore;

a first scroll member rotatably disposed in the suction pressure portion of said hermetic shell, said first scroll member having an end plate with a first upstanding involute portion and a drive stub, said drive stub further having a bore defining a discharge aperture;

a second upstanding scroll involute in the suction pressure portion of said hermetic shell, said second scroll involute in interleaving engagement with said first scroll involute;

a motor disposed in the discharge pressure portion of said hermetic shell;

an axially pressure balanced drive shaft rotatably disposed in said hermetic shell, said drive shaft having a first end in the central bore of said frame, said first end has an exterior diameter F, and a second end defining a crank portion in the suction pressure portion of said hermetic shell, said second end further having an eccentric circular cavity of diameter S for biasingly engaging said drive stub of said first scroll member, said drive shaft axially pressure balanced by fluid at discharge pressure acting on an area bounded by the diameter S and fluid at discharge pressure acting on an area bounded by the diameter F.

11. The method of axially pressure balancing a drive shaft in a hermetic fluid compressor as set forth in claim 10 comprised of the further step of selecting the exterior diameter F and the circular cavity diameter S to provide a desired net axial balancing thrust on the drive shaft.

* * * * *